137-13
5/15/79 XR 4,154,195

United States Patent [19]
Mugrauer

[11] 4,154,195
[45] May 15, 1979

[54] PRINTING DEVICE UTILIZING SOLVENT DISSOLVED TONER APPLIED TO A RECORDING CARRIER

[75] Inventor: Hubert Mugrauer, Pöring, Fed. Rep. of Germany

[73] Assignee: Siemens Aktiengesellschaft, Berlin & Munich, Fed. Rep. of Germany

[21] Appl. No.: 851,940

[22] Filed: Nov. 16, 1977

[30] Foreign Application Priority Data

May 2, 1977 [DE] Fed. Rep. of Germany ..... 2719575

[51] Int. Cl.[2] ..... B05B 1/08; B05B 5/02
[52] U.S. Cl. ..... 118/659; 101/DIG. 13; 118/312; 239/708; 346/153; 427/15; 423/658.5; 137/13
[58] Field of Search ..... 346/153, 140 R, 140 A, 346/139 R; 101/DIG. 13; 239/15, 418, 426; 118/621-635, 659, 312, 326, 323, 324, 325; 427/14, 15, 17, 27, 32, 33, 197, 421, 424, 426; 355/3 DD, 10

[56] References Cited

U.S. PATENT DOCUMENTS

| | | | |
|---|---|---|---|
| 2,753,796 | 7/1956 | Wood et al. | 346/153 X |
| 2,919,170 | 12/1959 | Epstein | 346/153 |
| 3,983,801 | 10/1976 | Watanabe et al. | 101/DIG. 13 |
| 4,013,004 | 3/1977 | Watanabe et al. | 101/DIG. 13 |

OTHER PUBLICATIONS

*IBM Technical Disclosure Bulletin,* "Mist Ink Printers", McCurry et al., vol. 15, No. 8, [Jan. 1973], pp. 2389-2391.

*Primary Examiner*—Morris Kaplan
*Attorney, Agent, or Firm*—Hill, Gross, Simpson, Van Santen, Steadman, Chiara & Simpson

[57] ABSTRACT

A printing device in which solvent dissolved toner is applied to a recording carrier to produce a symbol or image wherein a printing head is received interior of a housing with toner particles circulated in the housing in a gas stream. Solvent ejectors within the print head are positioned adjacent a slot opening of the housing and direct a toner-solvent stream against a recording carrier exterior of the housing.

8 Claims, 1 Drawing Figure

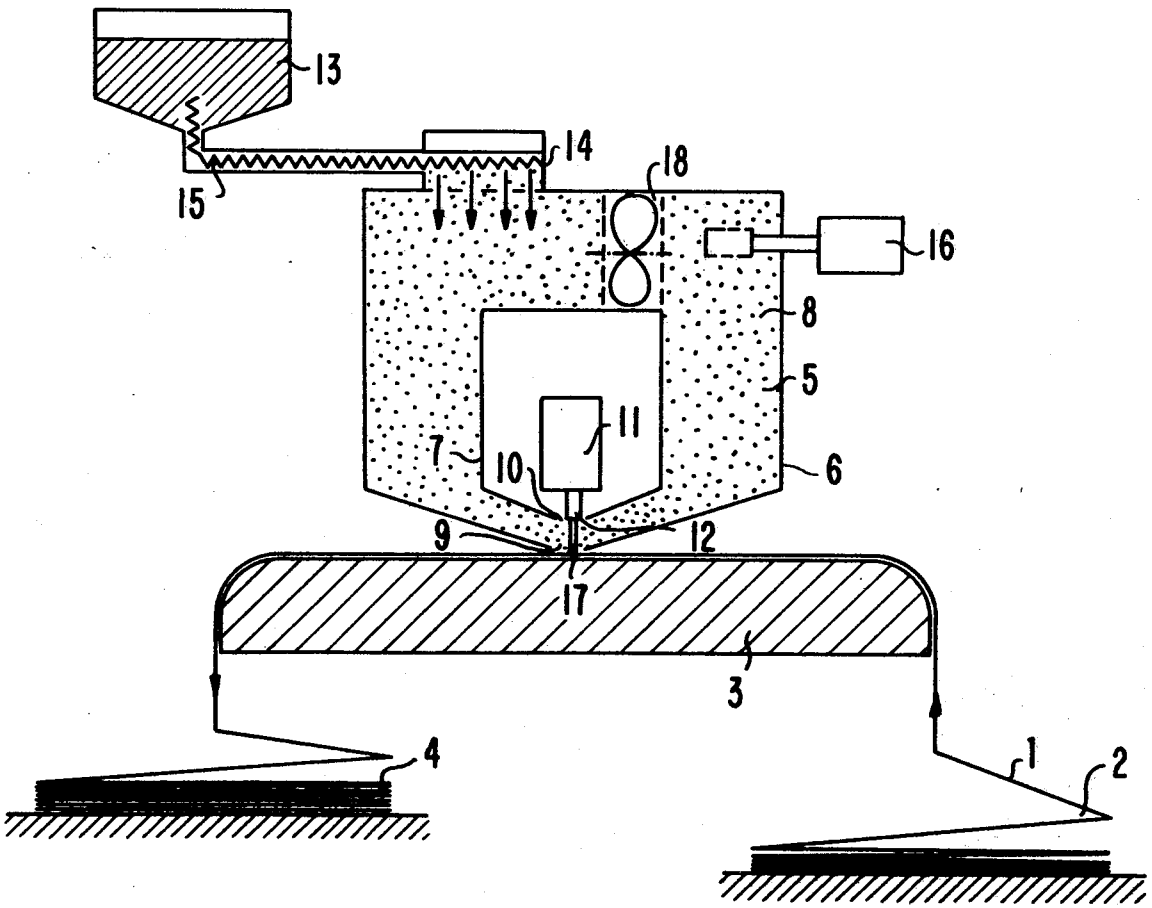
1
2
3
4
5
6
7
8
9
10
11
12
13
14
15
16
17
18

PRINTING DEVICE UTILIZING SOLVENT DISSOLVED TONER APPLIED TO A RECORDING CARRIER

BACKGROUND OF THE INVENTION

1. Field of the Invention

This invention relates to a device for printing indicia on a recording carrier wherein toner is dissolved with the aid of a solvent and is fixed on the recording carrier.

2. Prior Art

Nonmechanical printers or copiers are well known. See, for example, U.S. Pat. No. 3,861,863. Such nonmechanical printers generally work on electrostatic principles. In such devices, toner images of the symbols or image to be printed or copied are applied to a recording carrier, such as a paper web. The creation of the toner images can be done, for example, by generating electrophotographic or electrographic charged latent images corresponding to the indicia to be imprinted on a photoelectric or dielectric intermediate carrier, such as a drum. The latent images are then developed at a developing station by application of toner. The resultant toner images are then transferred to the recording carrier at a transfer station. To make the toner images permanent and unblurable, they must thereafter be fused into the recording carrier at a fixing station. Such fusing of the toner image can be done, for example, by exposing the toner image to a solvent vapor. See, for example, U.S. Pat. No. 3,049,810. The solvent vapor dissolves the toner to the extent that it can easily penetrate into the recording carrier and become securely adhered thereto.

It is further known in the art to procure the latent image directly on the recording carrier and to thereafter develop the latent image on the recording carrier by application of toner which is subsequently fixed. In such usages, the recording carrier has to have appropriate properties.

SUMMARY OF THE INVENTION

It is a primary object of this invention to provide a device for nonmechanical printing on a recording carrier wherein the symbols to be imprinted are formed on the recording carrier with a toner dissolved by a solvent so that the toner can penetrate into the recording carrier.

This primary object is achieved by positioning a printing head in a housing. A stream of gas with suspended toner particles is circulated in the inter-space between a printing head container and the housing. The housing has a slot adjacent to the recording carrier through which toner particles can emerge. The container includes at least one solvent pressure nozzle having an outlet directed at the inter-space between the container and the housing slot. The nozzle emits a stream of solvent which passes through the cloud of toner in the area of the slot towards the recording carrier. In the process, the solvent stream picks up and conveys toner particles to the recording carrier and dissolves them.

By circulating the toner particles in a gas stream within the housing, it is assured that toner particles will be repeatedly moved past the slot and therefore in the vicinity of the recording carrier. This stream or cloud of toner particles also exists in the space between the solvent pressure nozzle and the recording carrier. The solvent emerges from the solvent pressure nozzle under control either in a vapor or liquid form. The fine solvent stream passes through the cloud of toner particles and thence onto the recording carrier. By means of this process, toner particles are extracted from the cloud of toner and transferred onto the recording carrier. In this manner, the target area of the recording carrier is colored by the impinging toner. The solvent dissolves the toner so that the toner will penetrate into the recording carrier to become a permanent part thereof.

In the preferred embodiment, the housing is positioned at right angles to the recording carrier and is at least as broad as the area of the recording carrier to be imprinted. Similarly, the slot in the toner cloud containing housing is at least as wide as the area of the recording carrier to be printed. The outlet channel of the solvent pressure nozzle can be through an opening in the container which is adjacent the housing slot.

In one embodiment, a row of adjacent solvent pressure nozzles can be arranged in the container with the individual nozzles actuated to produce solvent streams which will play on a portion of the recording carrier in which a symbol is to be produced.

Alternatively, if only one solvent pressure nozzle is provided in the container, the nozzle should be movable at right angles to the direction of movement of the recording carrier.

In order to provide for continuous dispersion of toner particles within the housing, a fan means may be provided to create a circulating gas stream.

In order to limit the deposit of toner particles on the recording carrier and to reduce undesired depositation of toner on the recording carrier, the recording carrier can be given an electrostatic charge having a polarity opposite the toner.

A particular advantage of a device according to this invention lies in the fact that the printer symbols are produced directly on the recording carrier. Further, the symbols are produced and fixed on the recording carrier in a single operation.

Other objects, features and advantages of the invention will be readily apparent from the following description of a preferred embodiment thereof, taken in conjunction with the accompanying drawing, although variations and modifications may be effected without departing from the spirit and scope of the novel concepts of the disclosure, and in which:

BRIEF DESCRIPTION OF THE DRAWINGS

The FIGURE of the drawing is a schematic cross sectional view of a recording device according to this invention.

DESCRIPTION OF THE PREFERRED EMBODIMENT

The FIGURE diagrammatically outlines a device for printing according to this invention by means of solvent jets directed through a cloud of toner particles onto a recording carrier.

A recording carrier 1 which may, for example, be a sheet of paper, moves from a feed stack 2 over a guide plate 3 to a receiving stack 4. In order to be able to print indicia on the recording carrier 1, a printing head 5 is positioned adjacent to the path of movement of the recording carrier and opposed to the guide plate 3.

The printing head 5 includes a housing 6 in which a container 7 is positioned. In the inter-space 8 between the housing 6 and the container 7 a stream of gas with suspended toner particles is circulated. The circulation of the gas stream can be produced by a fan 18.

The housing 6 has a slot 9 therethrough positioned in opposition to the recording carrier 1. The slot 9 should be at least as wide as the area of the recording carrier which is to be printed. Additionally, the housing 6 must also be at least as wide as the area to be imprinted. Adjacent slot 9, container 7 has at least one opening 10. Positioned within the container 7 is at least one solvent pressure nozzle 11. The solvent pressure nozzle 11 has an outlet channel 12 projecting into the opening 10 of container 7. If desired, the printing head SK can include a single solvent pressure nozzle 11 which is movable at right angles to the direction of movement of the recording carrier. Alternatively, the printing head may be composed of a plurality of adjacent solvent pressure nozzles 11 which create a row of such pressure nozzles.

In order to make up for toner loss during printing, a storage container 13 is provided holding a toner supply. The toner is conveyed to a toner atomizer 14 by means of a feed spiral 15. The toner atomizer is such to insure that the supplied toner is uniformly distributed in the gas stream circulating within the inter-space 8. Concentration of toner within the gas stream can be controlled with the aid of a concentration sensor 16. Such a sensor, may, for example, be a particle counter, an opacity measuring device or the like type of sensor which can control directly, or indirectly, the toner feed spiral 15.

To produce a part of a symbol to be imprinted, that is, a spot shaped zone or a strip of the symbol, on the recording carrier 1, the solvent pressure nozzle 11 which is associated with that area is activated. Upon activation of a given solvent pressure nozzle, a stream of solvent 17 will be expelled from the outlet channel 12. This stream will pass through the toner cloud which is moving between the outlet channel 12 and the slot 9. The steam will pick up toner particles from the toner cloud and carry them to the recording carrier 1. In the process, the solvent stream will also reach the recording carrier and will dissolve the toner particles impinging on the recording carrier. The dissolved toner particles can then fuse into the recording carrier. The solvent pressure nozzle 11, and particularly the outlet channel portion 12 thereof, can be so constructed that the exiting stream of solvent is very fine. In this manner, toner particles carried by the exiting stream will only color the desired zone on the recording carrier.

Although the design of the solvent pressure nozzles 11 can be otherwise, presently existing jet ink printers may be used as a basis therefore. Reference is made to U.S. Pat. No. 4,005,440, the teachings of which are herein incorporated by references for disclosure of such ink printers.

In order to reduce undesired depositation of toner on the paper, the paper or other recording carrier can be given an electrostatic charge which has a polarity opposite to that of the toner. This can be accomplished by charging the guide plate with an appropriate electric charge. Furthermore, the pressure nozzles themselves can have an opposite electrical potential which will avoid undesired depositation of toner on the pressure nozzles. The toner can be charged in any known manner such as, for example, tribo-electrically.

Methylene chloride can be used as the solvent while conventional dry plastic base dies are usable as toners.

It can therefore be seen from the above that my invention provides a nonmechanical printer assembly wherein a printing head mechanism includes a container positioned interior of a housing. A gas stream or cloud of toner suspended particles is circulated in the housing. The housing has an exit slot therefrom aligned with the printing mechanism in the container. The printing mechanism includes at least one solvent pressure nozzle having an outlet channel directed at the slot, the slot being in opposition to a recording carrier. Activation of the solvent pressure nozzle creates a stream of solvent which passes through the cloud of toner thence through the slot to the recording carrier whereby the toner is deposited on the recording carrier with the solvent acting to dissolve the toner such that the toner is securely adhered to the recording carrier.

Although the teachings of my invention have herein been discussed with reference to specific theories and embodiments, it is to be understood that these are by way of illustration only and that others may wish to utilize my invention in different designs or applications.

I claim as my invention:

1. In a solvent dissolved toner device for producing symbols on a recording carrier by toner dissolved by a solvent, the improvement of a housing member having a container disposed therein, means circulating a gas stream of suspended toner particles in an interspace between the container and housing, the housing having an exit slot therethrough adjacent a recording carrier exterior of the housing, the container having an opening aligned with said slot, at least one solvent pressure nozzle disposed in said container and having an outlet channel directed to the interspace between the container opening and the slot, the solvent pressure nozzle including means for emitting a solvent stream through said outlet channel thence through said gas stream of suspended toner particles thence through the slot whereby toner will be picked up by said solvent stream and conveyed through said slot onto said recording carrier, said toner being dissolved by said solvent stream.

2. The device of claim 1 wherein the housing is aligned at right angles to a direction of movement of the recording carrier, the recording carrier being movable, said housing being at least as wide as an area of the recording carrier which is to be subject to imprinting by the device, said slot being at least as long as said area, the container having at least one opening therethrough adjacent said slot with the outlet channel of the solvent pressure nozzle being aligned with said opening.

3. The device according to claim 1 wherein a row of solvent pressure nozzles is positioned interior of said container, the outlet channels of each of the pressure nozzles of the row being aligned with openings in the container, the openings being aligned with the slot.

4. The device according to claim 2 wherein a single solvent pressure nozzle is positioned in the container, said nozzle being movable in a plane normal to a direction of movement of the recording carrier, the slot being aligned with said plane.

5. A device according to claim 2 wherein the suspended toner particle gas stream is moved within said housing by means of a circulating fan.

6. The device according to claim 5 wherein the recording carrier moves over a base member positioned in opposition to the slot, the base member having an electrical potential having a charge opposite a charge on the toner particles.

7. The device according to claim 5 wherein a row of solvent pressure nozzles is positioned interior of said container, the outlet channels of each of the pressure nozzles of the row being aligned with openings in the container, the openings being aligned with the slot.

8. A solvent dissolved toner printing device comprising a housing, a container disposed in said housing, said container having an opening, at least one solvent pressure nozzle means disposed in said container, said nozzle having an outlet channel aligned with said opening, said housing having a slot exit aligned with said opening, means providing a toner supply to said housing, means circulating a gas stream with toner particles suspended therein within said housing past an inter-space between said opening and said slot, and said solvent pressure nozzle means effective to eject a flow of solvent therefrom through the inter-space and thence through the slot, movement of the solvent flow through the inner space causing a flow of toner particles therewith.

* * * * *